US007442100B2

(12) United States Patent
Korhonen et al.

(10) Patent No.: US 7,442,100 B2
(45) Date of Patent: Oct. 28, 2008

(54) METHOD AND APPARATUS TO CONTROL A SHIP

(75) Inventors: Vesa Korhonen, Espoo (FI); Risto Pakaste, Helsinki (FI); Antti Ruohonen, Helsinki (FI); Petri Sullström, Kirkkonummi (FI); Panu Virolainen, Espoo (FI); Petteri Ämmälä, Baden-Dättwil (CH); Matti Lehti, Espoo (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 10/552,727

(22) PCT Filed: Apr. 13, 2004

(86) PCT No.: PCT/FI2004/000225

§ 371 (c)(1),
(2), (4) Date: Jul. 7, 2006

(87) PCT Pub. No.: WO2004/089740

PCT Pub. Date: Oct. 21, 2004

(65) Prior Publication Data

US 2006/0246793 A1 Nov. 2, 2006

(30) Foreign Application Priority Data

Apr. 11, 2003 (FI) ..... 20030556

(51) Int. Cl.
*B63H 21/21* (2006.01)

(52) U.S. Cl. ..... 440/1

(58) Field of Classification Search ..... 440/1, 440/3, 6, 50, 84, 87, 79, 80; 114/144 RE
See application file for complete search history.

(56) References Cited

U.S. PATENT DOCUMENTS

| | | | | |
|---|---|---|---|---|
| 4,519,335 | A * | 5/1985 | Krautkremer et al. | 114/144 R |
| 5,031,561 | A | 7/1991 | Nilsson | |
| 5,061,212 | A | 10/1991 | Morgenthaler et al. | |
| 5,795,199 | A | 8/1998 | Langenberg et al. | |
| 6,190,217 | B1 | 2/2001 | Huot-Marchand et al. | |
| 2004/0198108 | A1 * | 10/2004 | Levander | 440/80 |

FOREIGN PATENT DOCUMENTS

| | | | |
|---|---|---|---|
| EP | 0117881 | A1 | 9/1984 |
| EP | 1329379 | A1 | 7/2003 |
| WO | 03099651 | A1 | 12/2003 |

* cited by examiner

*Primary Examiner*—Sherman Basinger
(74) *Attorney, Agent, or Firm*—Buchanan Ingersoll & Rooney PC

(57) ABSTRACT

The invention relates to a method and an apparatus to control a propulsion drive. The propulsion drive comprises at least one first propeller drive, which rotates the first propeller and by which the propulsion power and/or rotating speed of the first propeller, and a second propeller drive, by which the second propeller is rotated and controlled. According to the invention the propulsion drive is controlled by a single control command, whereby it is generated from the control command a first control signal, by which the first propeller drive is controlled, and a second signal, by which the second propeller drive is controlled.

21 Claims, 3 Drawing Sheets

METHOD AND APPARATUS TO CONTROL A SHIP

Figure 1:
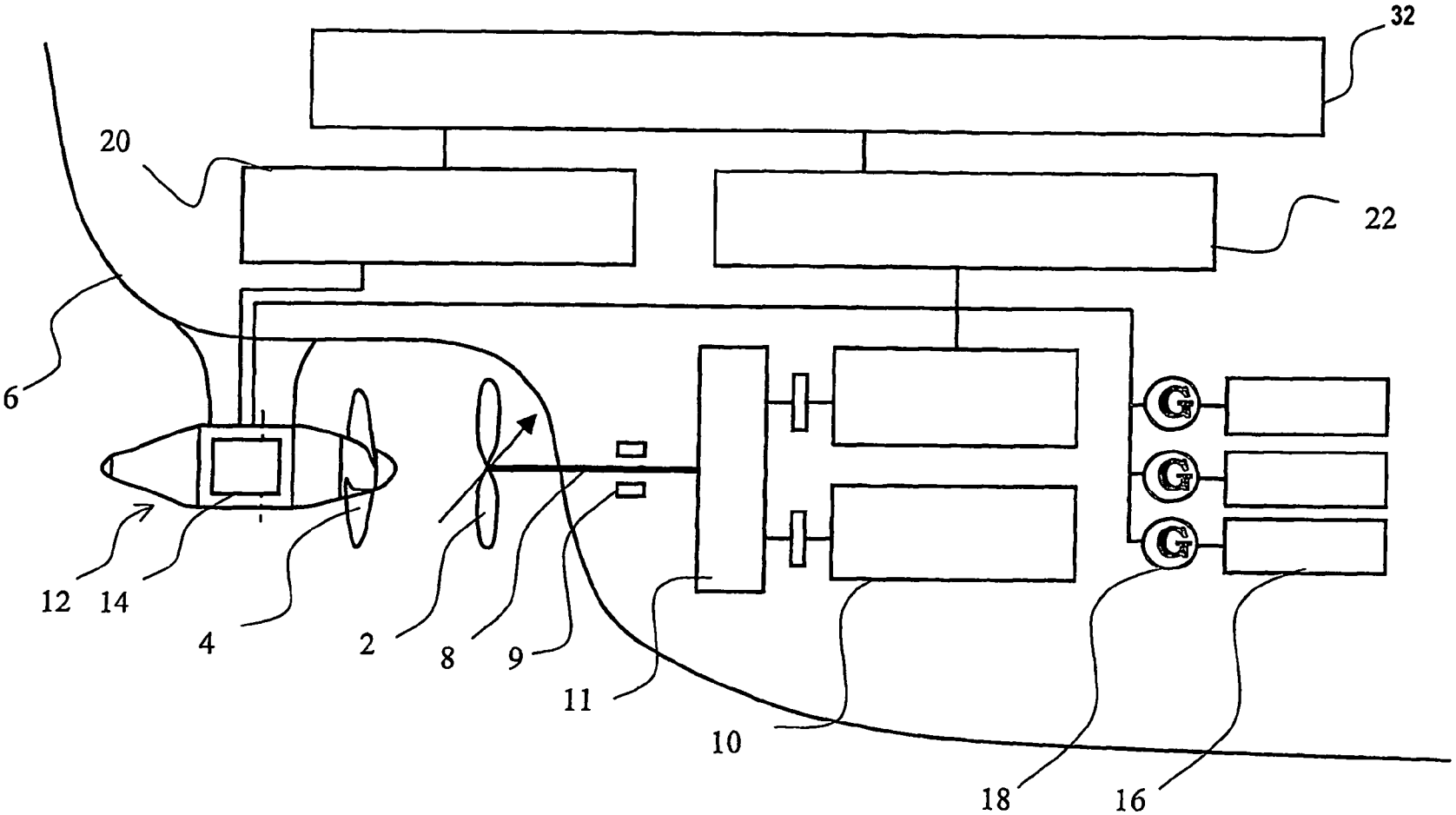

The invention relates to a method and an apparatus to control a ship, whereby the ship is propelled and/or steered at least by two propulsion means.

The propulsion system for large water vessels often consists of several propeller apparatus, whose operation, control and structure varies from each other case by case. As an example one can mention a system which is composed of main propellers and of separate steering propellers or a system which is composed of two fixed main propellers and of separate steering device. Further there can be propellers with fixed blades and propellers with adjustable blades in the propeller system. One profitable method of implementation consists of propellers which have been arranged one after the other on the same axis and which rotate in contradictory directions, so called CRP-propulsion apparatus (CRP=contra rotating propeller).

In ship drives, where the steering and/or the propulsion action is caused by two different propulsion devices, the steering commands must be given in a manner that corresponds the characteristics of the propulsion device. Roughly grouped e.g. the control command defining the direction of the ship and the control command defining the speed of the ship must be given separately. The ship operator may give the steering command by one control device, like by a control stick, but the actual controlling signal of the propulsion devices is separate to different type of devices. Correspondingly, the control of the blade angles with the controllable pitch propeller may be separate from the control of the propeller's rotating speed or the mutual control of the CRP-system's propellers is separate.

The purpose of the ship's propulsion system is as efficiently as possible to carry out the control commands of the ship's operator under all circumstances. The mutual control of the adjustable drives must thus carry out the control commands in such a way that all parts of the system operate optimally. The total efficiency must also be as high as possible in all operation situations. E.g. the steering command given by a control stick in a azimuth type system when running a specific speed can cause to a control action, which has a right direction, but the propulsion power is no more optimal because of the changed position of the steering propeller and the fixed propeller. Correspondingly mere adjustment of the blade angle may cause reduction of overall efficiency, if the propellers speed is not simultaneously as required by the CRP-function.

Generally speaking in a system that consists of two or more propulsion devices one control action focusing to one propulsion device also affects to the operation of the other propulsion devices and thereby to the operation and to the efficiency of the whole system.

The drive and energy system of the ship is closed where the available energy and power are variously limited both under normal drive situation and especially under exceptional circumstances. The limitations may be caused both by the energy or power production and by the adjustability characteristics of the apparatus. The control may affect except the efficiency of the propulsion system but also the reliability of the propulsion system. The forces applied to the propeller vary significantly, when e.g. the deflection angle of the steering propeller of the CRP-system realized with the azimuth mechanism.

Previously e.g. the U.S. Pat. No. 5,061,212 has disclosed an adjusting device of the propeller's blade angle, by which the blade angle is adjusted depending on the speed. Controlling of the mutual angle difference between two propellers that are arranged on different shafts in such a way that the noise level remains low is disclosed in the U.S. Pat. No. 6,190,217.

The purpose of this invention is to create a new propulsion system, by which the control of the drive mechanism in a ship having several propulsion apparatus will be carried out as efficiently as possible.

The solution according to the invention results a very favorable overall efficiency of the ship's propulsion apparatus. The control command from the vessel's bridge, or from another steering place like machine room, is conducted to the main controller, which processes and delivers the control command as control signals, which deal with the various propulsion devices. Thereby the main controller notices the operational situation of the propulsion devices, the selected drive mode of the vessel, the limitations of the propulsions devices, the status of the energy and power supply systems. Likewise the optimal operating point of the propulsion devices when generating the control signals is defined based to their characteristics or to their corresponding operating values. The first and the second propeller drive are essentially separated from each other, whereby they are not coupled onto the same shaft. The shafts of the propellers have neither coaxial structure, but they are arranged physically apart from each other.

In the CRP arrangement the counter rotating propellers, which are one after the other in the longitudinal direction of the ship, are generally arranged essentially on the same horizontal level. It is essential for the propulsion arrangement that propellers cause a propulsion effect that is as advantageous as possible. Accordingly the invention is applicable to such propulsion systems, where the propellers have a mutual propulsion effect.

According to one profitable modification the vessel's propulsion system consists of a fixed propulsion means and a turnable, so-called azimuth propulsion means. The main control thus generates a control signal to the fixed propulsion means, e.g. directly to power engine, which rotates the shaft, on which the propulsion means is fixed. Simultaneously, the main control generates another control signal, by which the power and rotating speed of the azimuth propulsion means is controlled. How each control signal effects to the propulsion means that it controls is determined by the internal attributes and the adjusting means of that propulsion means. These functions are carried out by the manners known in the art to generate the desired speed for the ship. In accordance with the invention the control signals are adjusted so that the combined effective power of the propulsion devices is optimized.

According to one further profitable embodiment the emergency stop is carried out by the invention. Thereby the blade angle of the first propeller and the operating speed of the second propeller are adjusted simultaneously so that they concurrently have zero value and that they both are adjusted towards negative values causing the stop of the ship.

The invention will be described in detail by its one embodiment referring to the drawings, wherein FIG. 1 describes a propulsion arrangement of a ship controlled in accordance with the invention, FIG. 2 describes a schematic diagram of a control system according to the invention and FIG. 3 describes the characteristics of the propulsion arrangement.

The propulsion system of a vessel described in the FIG. 1 consists of a main propeller 2 and a steering propeller 4, which are fit on the same longitudinal line of the ship 6. The propellers are arranged in the normal mode to rotate in contrary directions, whereby they compose a so-called CRP propulsion system. The shaft 8 of the main propeller is supported by the bearings 9 to the hull 6 and the main engine 10 of the ship, like diesel engine supplies drive power to the shaft. Two diesel engines are shown in the figure and the propeller shaft 8 is coupled to the engine via a gear 11 and/or via a coupling. In case that only one main engine is used the main engine may be directly coupled to the propeller shaft. If the main propeller 2 has adjustable blades, they are controllable in the way known as such. The main propeller may also have fixed blades. The steering propeller 4 is arranged to a turning, so called azimuth apparatus 12, whereby the allowed turning angle of the apparatus may vary from ±35 degrees as far as ±360 degrees. The electric network of the ship, which is energized by generators 18 rotated by the main engine 10 or other power engines 16, supplies an electric motor 14 rotating the steering propeller. The steering propeller 4 and the main propeller 2 are controlled by their own control devices, by the azimuth control device 20 and by thruster control device 22, respectively. In accordance with the invention the azimuth control 20 and the thruster control 22 receive their control signals from a CRP control. The invention may be applied except to the apparatus comprising the turning steering propeller also to a propeller system with a fixed pod, in which case the steering is carried out by a separate rudder.

Figure 2:
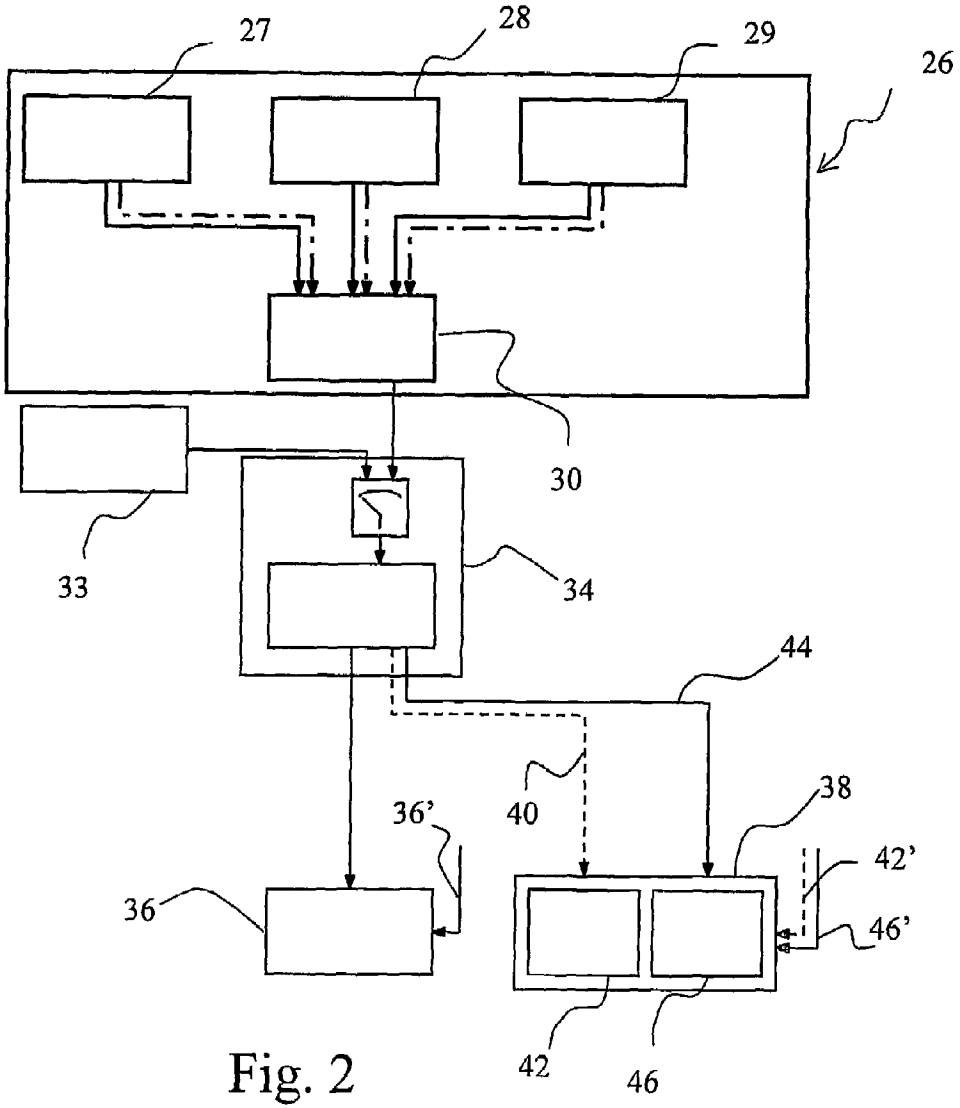
Figure 3:
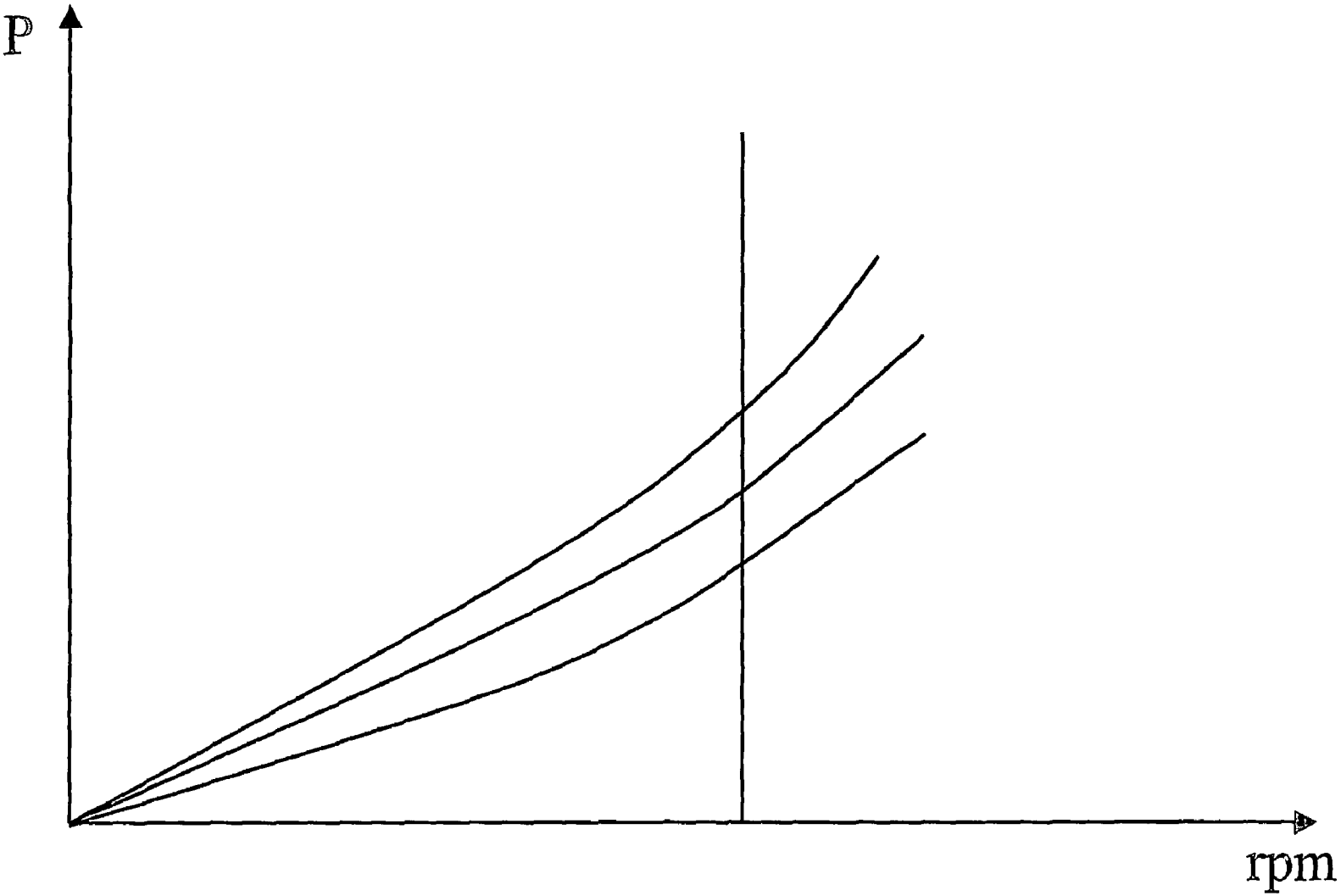

The propulsion system of the FIG. 1 is controlled by a control scheme of the FIG. 2. It is to be understand that the scheme only shows the essential parts that effect to the solution of the invention and the other parts of the control system, especially the parts effecting solely to different propulsion devices or to their internal control operations are shown suggestively. The control commands are given on the bridge 26, which control commands determine the speed and direction of the vessel. Depending on the command location the commands are given from the middle 28 of the bridge or from the command device of port 27 or starboard 29. The effective command device is selected by a selecting device in a known manner. If required the control commands can also be given by the control device 32 locating in the machine room. The control commands are transferred to the CRP control unit 34, which defines based to the operation stage the control signals to be forwarded to different propulsion units, to the azimuth unit and to main propeller. In addition to the control command the control signals are affected among other things by the power available on board, the combined propulsion power of the propulsion units, the operation mode of the vessel. From the CRP control 34 a control signal is sent to the control unit 36 of the azimuth propulsion, which defines the rotation speed of the motor 14 driving the propulsion unit and the rotation speed of the propeller 4 fixed on its shaft. Another control signal from the CRP control is sent to the control unit 38 of the main propeller, which based on the control signal defines rotation speed of the propeller 2 and the blade angle of the propeller so that the required propulsion power is generated. This is performed by the technique known from the control of the diesel drive and from the control of the controllable pitch propeller. Depending on the implementation either a separate control signal 40 is forwarded to the blade angle control 42 and a separate control signal 44 to the speed control 46 of the main propeller like the FIG. 2 shows or a common control signal of the main propeller is forwarded to the thruster control, which controls the pitch and the speed of the main propeller.

The CRP control defines according to the invention separate control signals both to the azimuth propulsion unit and to the main propeller as response to the control command. Accordingly in order to perform the control commands it is formed separately the control values for the azimuth unit to generate the required power and rotation speed, and correspondingly, the control values to control the rotation speed and blade angle of the main propeller. In the target of application, where the main propeller has fixed blades, the CRP control defines both to the main propeller and to the steering propeller the speed references, by which an optimal overall efficiency of the vessel is achieved. In the FIG. 3 there are described power curves of the propulsion motors, which are utilized when defining the control signal to the propeller drives. As adjustable variances there are the speeds of the motors and the pitch of the propeller, by which the best overall efficiency of the drive is determined in each situation During normal driving mode the controls for different propulsion systems are ramped so that the mutual power ratio of the propulsion systems remain in the desired limits.

In the combined propulsion control mode the azimuth propulsion and the main engine propulsion are driven by a determined mutual power/speed ratio. If the azimuth motor or the main engine is not capable to keep its reference value, the reference value of the other system is restricted in order to maintain the desired power/speed ratio. In the fault situation of the system the power/speed is kept, however, to the point where the full power of the failing system is achieved.

Both propulsion systems may have a back-up mode, which bypasses the CRP control. This is illustrated by the control inputs 36', 42' and 46' in the FIG. 2. The use of this mode may be selected independently to each system or to both systems simultaneously.

The invention has been described by its certain embodiments. This should not be regarded limiting, but the modifications of the invention may vary within the scope of the attached claims.

The invention claimed is:

1. Method for controlling a propulsion drive, which drive comprises at least one first propeller drive which rotates a first propeller in a first direction of rotation, and by which at least one of: the propulsion power and rotating speed of the first propeller is adjusted, and at least one second propeller drive, by which a second propeller is rotated in a second direction of rotation opposite to the first direction of rotation, and adjusted, the first and second propellers arranged longitudinally one after the other, the first and the second propeller drives are essentially separated from each other, wherein the method comprises controlling the propulsion drive by a single control command, whereby a first control signal for controlling the first propeller drive, and a second control signal for controlling the second propeller drive, are generated from the single control command.

2. Method according the claim 1, wherein the first and the second control signal are generated to optimize one or more of propulsion and steering power.

3. Method according the claim 1, wherein the propellers driven by the first and the second propeller drives are arranged on the essentially same horizontal level.

4. Method according the claim 1, wherein the first propeller drive is an electrical motor drive that has been arranged into an azimuth pod.

5. Method according the claim 1, wherein the second propeller drive is a power engine that has been arranged on a fixed shaft.

6. Method according the claim 1, wherein the propeller blades of the second propeller drive are controlled.

7. Method according the claim 1, wherein the propellers of the both propeller drives have fixed blades.

8. Method according the claim 1, wherein the rotating speed of the second propeller drive is controlled.

9. Method according the claim 1, wherein the rotating speed of the first propeller drive is controlled.

10. Method according the claim 1, wherein the power of the first and/or the second propeller drive is controlled.

11. Method according the claim 1, wherein in an emergency situation the blade angle of the first propeller and the operating speed of the second propeller are adjusted simultaneously so that they concurrently have zero value and that both the blade angle and the operation speed of the propellers are further adjusted towards the opposite direction until causing the stop of the ship.

12. Apparatus for controlling a propulsion drive, which comprises at least one first propeller drive which rotates a first propeller in a first direction of rotation, and by which at least one of: the propulsion power and the rotating speed is controllable, and at least one second propeller drive, by which a second propeller is rotatable in a second direction of rotation opposite to the first direction of rotation, and controllable, the first and second propeller arranged longitudinally one after the other, the first and the second propeller drive are essentially separated from each other, wherein the apparatus comprises a control device to control the propulsion drive by a single control command, whereby based on the single control command the control device generates a first control signal, by which the first propeller drive is controllable, and a second control signal, by which the second propulsion drive is controllable.

13. The method of claim 1, further comprising providing the single control command through a single input device.

14. The apparatus of claim 12, wherein the single control command is generated through a single input device.

15. The method of claim 1, further comprising transmitting the first control signal to a first control unit, and transmitting the second control signal to a second control unit.

16. The apparatus of claim 12, further comprising a first control unit for receiving the first control signal, and a second control unit for receiving the second control signal.

17. An arrangement comprising:

a first propeller drive which rotates a first propeller;

a first control unit operatively associated with the first propeller drive, the first control unit constructed and arranged to control at least a first operational parameter associated with the first propeller drive;

a second propeller drive which rotates a second propeller;

a second control unit operatively associated with the second propeller drive, the second control unit constructed and arranged to control at least a second operational parameter associated with the second propeller drive; and a main control unit constructed and arranged to receive a single control command, and based on the single control command, produce and transmit both a first control signal to the first control unit and a second control signal to the second control unit, thereby affecting both the first operational parameter and the second operational parameter, and wherein the first operational parameter differs from the second operational parameter.

18. The arrangement of claim 17, wherein the first operational parameter comprises at least one of the rotational speed of the first propeller drive and the pitch of the first propeller drive, and the second operational parameter comprises at least one of the power and rotational speed of the second propeller drive.

19. The arrangement of claim 17, wherein the first propeller is rotatable in a first direction of rotation and the second propeller is rotatable in a second direction of rotation, and the first and second propellers are arranged longitudinally one after the other.

20. The arrangement of claim 17, wherein the single control command is generated through a single input device.

21. The arrangement of claim 17, wherein the main control unit defines an optimal operating condition based on characteristics and operating values of the first and second propeller drives, and generates the first control signal and the second control signal based upon the optimal operating condition.

* * * * *